US007127682B2

(12) United States Patent
Sandström et al.

(10) Patent No.: US 7,127,682 B2
(45) Date of Patent: Oct. 24, 2006

(54) DEVICE AND SYSTEM FOR INFORMATION MANAGEMENT UTILIZING A FILING APPLIANCE

(75) Inventors: Ola Sandström, Lund (SE); Christer Fåhraeus, Lund (SE)

(73) Assignee: Anoto AB, Lund (SE)

( * ) Notice: Subject to any disclaimer, the term of this patent is extended or adjusted under 35 U.S.C. 154(b) by 615 days.

(21) Appl. No.: 09/986,378

(22) Filed: Nov. 8, 2001

(65) Prior Publication Data

US 2002/0059016 A1 May 16, 2002

Related U.S. Application Data

(60) Provisional application No. 60/257,835, filed on Dec. 21, 2000.

(30) Foreign Application Priority Data

Nov. 10, 2000 (SE) ..... 0004105

(51) Int. Cl.
*G09G 5/00* (2006.01)

(52) U.S. Cl. ..... 715/780; 714/846; 714/847; 345/157; 345/162; 345/179

(58) Field of Classification Search ..... 345/740, 345/748, 737, 780, 864, 901, 157, 162, 179, 345/773; 715/780, 847
See application file for complete search history.

(56) References Cited

U.S. PATENT DOCUMENTS 4,972,496 A * 11/1990 Sklarew ..... 382/187
5,535,063 A * 7/1996 Lamming ..... 360/4
5,603,053 A * 2/1997 Gough et al. ..... 710/5
5,661,506 A 8/1997 Lazzouni et al.
5,852,434 A 12/1998 Sekendur
5,950,188 A * 9/1999 Wildermuth ..... 707/3
6,335,727 B1 * 1/2002 Morishita et al. ..... 345/179
6,563,494 B1 * 5/2003 Eichstaedt et al. ..... 345/179
6,738,053 B1 * 5/2004 Borgstrom et al. ..... 345/179

FOREIGN PATENT DOCUMENTS

WO 99/50787 10/1999
WO 00/72133 A1 11/2000
WO WO 00 72110 A2 11/2000
WO 00/73983 A1 12/2000
WO 01/26032 A1 4/2001
WO 01/61449 A2 8/2001

OTHER PUBLICATIONS

Microsoft PowerPoint 2000, Copyright 1987-1999, pp. 1-3.*

* cited by examiner

*Primary Examiner*—Kristine Kincaid
*Assistant Examiner*—Sajeda Muhebbullah
(74) *Attorney, Agent, or Firm*—Birch, Stewart, Kolasch & Birch, LLP

(57) ABSTRACT

The invention relates to a filing appliance, a system for information management, a method in a computer system, a computer program and a memory medium. The filing appliance includes a holder for holding a plurality of sheets, with at least one input field, which is provided with a position-coding pattern and is adapted to be filled in using a drawing device, which while using the position-coding pattern records positions in the input field in order to record information entered in the input field, and an initiation icon provided with a position-coding pattern, a marking of the initiation icon using the drawing device being adapted to initiate an operation in a computer system communicating with the drawing device, in which operation an information object is created, which is identifiable at least by information entered in the input field.

27 Claims, 6 Drawing Sheets

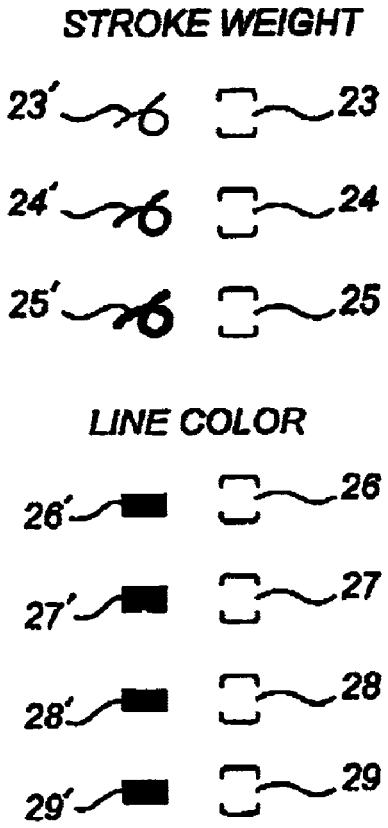
Fig. 8
Fig. 9
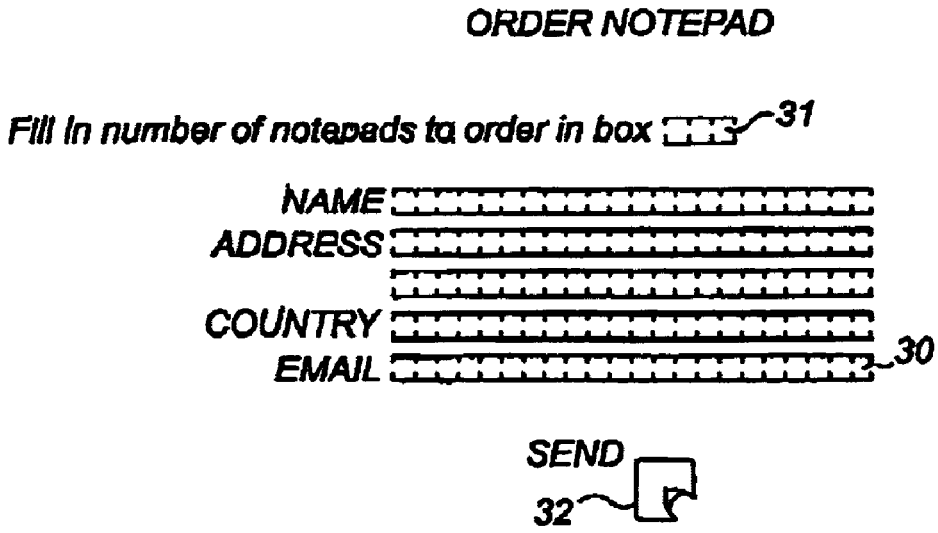

DEVICE AND SYSTEM FOR INFORMATION MANAGEMENT UTILIZING A FILING APPLIANCE

This application claims priority on provisional Application No. 60/257,835 filed on Dec. 21, 2000, the entire contents of which are hereby incorporated by reference.

FIELD OF THE INVENTION

The present invention relates to a filing appliance according to the preamble to claim 1, a system according to the preamble to claim 12, a method in a computer system according to the preamble to claim 18, a computer program according to claim 19 and a memory medium according to claim 20.

BACKGROUND ART

Filing appliances, binders, or files of the above-mentioned type, are used in huge amounts almost everywhere. A file or a filing appliance generally relates in the present application to a cover for use over and/(or) under a set of sheets of paper, like the cover of a book. The cover can, but need not, be more or less stiff. The file is provided with means for holding these sheets, which sheets in principle can also be made of other materials than paper. These means can be openable, such as in a ring binder, but the sheets of paper can also be permanently fixed to the filing appliance e.g. by means of a spiral binding, such as in a spiral binder, or by gluing, folding etc.

Filing appliances or files of this type are, as mentioned above, widely used, in many fields of application. A spiral binder can be used, for instance, to make notes about a specific subject field. The user of the binder can then use it at, for instance, lectures, seminars and in individual studies.

Filing appliances of prior-art type have, however, a number of limitations. It can be difficult to copy notes from such a filing appliance and this necessitates at least the use of a special copying machine which is not available to all users. Sharing, over long distances, notes from a filing appliance of prior-art type is not easy either. Of course, a sheet copied from the file can be faxed, which in addition to the above-mentioned copying machine also requires a fax machine. Alternatively, the pages that are to be transmitted can be scanned, which requires a flat bed scanner. In general, filing appliances of prior-art type result in complicated and expensive handling and communication of information, if writing down things on the sheets of paper of the filing appliance and reading the information written on the sheets is not sufficient.

SUMMARY OF THE INVENTION

An object of the present invention is to wholly or partly obviate the above-mentioned problems.

This object is achieved by a filing appliance as defined in claim 1 and a system according to claim 12, a method in a computer system according to claim 18, a computer program according to claim 19 and a memory medium according to claim 20.

More specifically, the invention according to a first aspect relates to a filing appliance comprising means for holding a plurality of sheets of, for instance, paper. The filing appliance is characterized by at least one input field which is provided with a position-coding pattern and is adapted to be filled in by means of a drawing device which digitally records, using said position-coding pattern, positions in the input field in order to digitally record information entered in the input field, and an initiation icon provided with a position-coding pattern, a marking of the initiation icon by means of the drawing device being adapted to initiate an operation in a computer system communicating with the drawing device, in which operation an information object is created, which is identifiable at least by means of information entered in the input field. This allows creating a "digital copy" of a filing appliance. Information that is subsequently entered into the filing appliance may also be copied and entered into this "digital filing appliance". The information is easily organized and lay be shared, for instance via e-mail.

Preferably, the input field is adapted to be filled in at least with handwritten text which can optionally be OCR interpreted. This allows easy identification and search of a created information object.

In a preferred embodiment, an input field is also adapted to be filled in at least with an illustration. This permits a more expressive way of recording an information object, which way is also independent of language and of full ability to read and write.

Preferably, sheets of paper in at least a subset of the plurality of sheets of paper are provided with a position-coding pattern, so that information which is filled in on a sheet of paper in the subset by means of said drawing device is recordable as a digital graphical input, which can be a vector based input, the filing appliance comprising a number of appearance icons, a marking of an appearance icon by means of the drawing device being adapted to give the digital graphical input a visual property, such as stroke weight or line color.

This allows more expressive graphical inputs to be recorded digitally.

In a preferred embodiment, the filing appliance comprises an address field provided with a position-coding pattern, and an order icon, a marking of the order icon by means of said drawing device being adapted to initiate an operation in the computer system, which operation performs an order of another filing appliance to be delivered to an address entered in the address field.

This allows easy ordering of new filing appliances

Preferably at least sheets of paper in a subset of the plurality of sheets of paper are provided with a position-coding pattern, so at information filled in on a sheet of paper in the subset can be recorded by means of said drawing device as graphical inputs, and a send icon provided with a position-coding pattern, a marking of the send icon initiating an operation in the computer system, in which operation graphical inputs entered on the sheet of paper and recorded digitally are transferred to the computer system and optionally on to an external computer system.

With such a filing appliance, transfer of information can be initiated without the user directly needing to initiate an operation in the computer system by means of e.g. a computer mouse or keyboard.

In a preferred embodiment, the information object comprises a table in a database. This simplifies arranging and editing of information entered in a system.

In an alternative embodiment, the information object comprises a file, which results in a comparatively simple recording procedure.

A filing appliance preferably comprises an archiving icon, a marking of the archiving icon being adapted to initiate an operation wherein position information corresponding to strokes of the drawing device, which strokes are generated after a reference time point, is transmitted from the drawing device to the computer system. This allows the user to utilize the drawing device and the filing appliance off line and subsequently transferring registered information.

According to a second aspect, the invention relates to a system for information management. The system is characterized in that it comprises a filing appliance, a drawing device and a computer system, and that the filing appliance comprises means for holding a plurality of sheets of paper, at least one input field which is provided with a position-coding pattern and adapted to be filled in by means of the drawing device which is adapted to record, using said position-coding pattern, positions in the input field in order to digitally record information entered in the input field, and an initiation icon provided with a position-coding pattern which is arranged in such manner that a marking of the initiation icon by means of the drawing device initiates such an operation in said computer system, which is adapted to communicate with the drawing device, so that an information object is created, which is identifiable at least by means of said information entered in the input field.

The system results in advantages corresponding to those of the above-mentioned filing appliance and can be modified similarly.

In a preferred embodiment of the system, the computer system is integrated with the drawing device. This results in a compact system that is easy to handle.

In yet another preferred embodiment, the filing appliance comprises an archiving icon provided with a position-coding pattern, which is arranged in such manner that a marking of the archiving icon by means of the drawing device initiates an operation wherein position information corresponding to strokes of the drawing device, which strokes are generated after a reference time point, is transmitted from the drawing device to the computer system. This allows the user to utilize the drawing device and the filing appliance offline and subsequently transferring registered information.

Preferably, the reference time point is set to the current time in connection with the transmission of the position information.

The reference time point may be stored in the drawing device, which is easy to implement, or it may be stored in the computer system which allows the drawing device to operate vis-à-vis several computer systems simultaneously.

According to a third aspect, the invention relates to a method for arranging incoming information in a computer system. The method is characterised in that a first information object in the computer system is open vis-à-vis an application in the computer system, the first information object being related to a first filing appliance; that position information, which arises when a drawing device is moved over a position coded pattern, is received by the computer system, wherein the position information which is generated at a time point $t_{act}$ comprises information that is intended to make open a second information object vis-à-vis the application in the computer system, the second information object being related to a second filing appliance; and that position information generated before said time point $t_{act}$ is inserted in the first information object whereas position information generated after said time point $t_{act}$ is inserted in the second information object. This allows the activation of a new filing appliance vis-à-vis the computer system to be performed offline. The computer system still arranges incoming information corrects.

BRIEF DESCRIPTION OF THE FIGURES

FIG. 8 shows, in a more distinct form, distinctive features indicated on the palette flap shown in FIG. 3.

FIG. 9 shows, in a more distinct form, distinctive features indicated on the order page shown in FIG. 4.

DESCRIPTION OF PREFERRED EMBODIMENTS

Figure 1A:
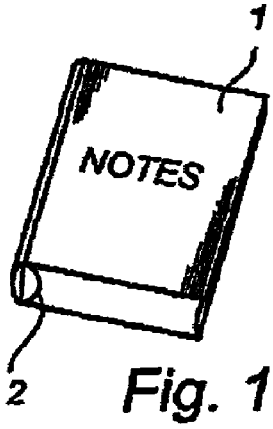
FIGS. 1*a* and 1*b* illustrate various conceivable embodiments of a filing appliance.
Figure 1B:
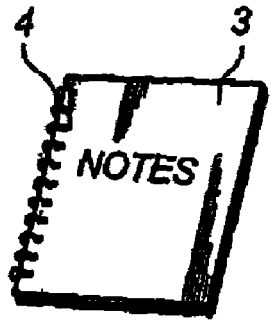

FIG. 1*a* and FIG. 1*b* illustrate various conceivable embodiments of a filing appliance.

In FIG. 1*a,* the filing appliance is in the form of a ring binder. Its cover parts 1 (of which the upper is visible and the lower is concealed), i.e. the parts encompassing the sheets of paper, are then preferably relatively stiff. A comparatively large number of sheets are with the aid of attachment means 2 of bifurcated form (also to be found in FIG. 2) releasably attached in the filing appliance.

In FIG. 1*b* the filing appliance is in the form of a spiral binder. The cover parts 3 are then usually softer than those of the ring binder and a usually somewhat smaller number of sheets of paper are then attached with the aid of attachment means 4 of coiled form. Also other types of attachment means than those mentioned above can be used, such as clamps.

Figure 2:
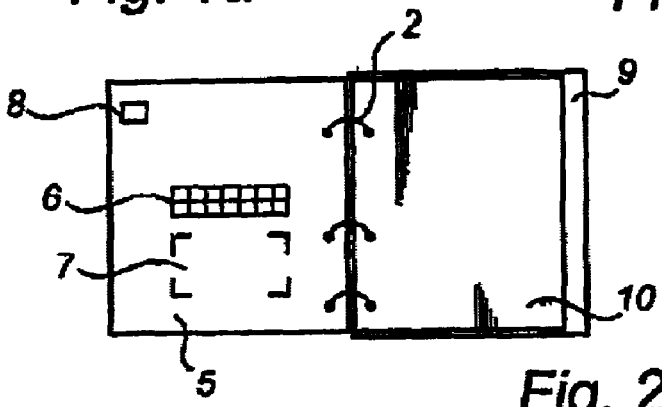
FIG. 2 illustrates an open filing appliance according to the invention.

FIG. 2 shows an open filing appliance according to the invention.

A first 6 and a second 7 input field as well as an initiation icon 8 are printed on the inside 5 of the top cover part. The first input field, the second input field and the initiation icon are shown more clearly in FIG. 6.

A user who intends to use the filing appliance fills in either text in the first input field 6 or an illustration in the second input field 7, or both. The first 6 and the second 7 input field are provided with a position-coding pattern (not shown) The position-coding pattern can be relatively coded, but is preferably absolutely coded, which will be discussed in more detail below. Also a combination of absolute and relative position-coding patterns can be used.

A user can fill in text or digits that he or she wants to characterize the filing appliance in the first input field. The text or digits are filled in by means of a drawing device of a type that simultaneously, while using the position-coding pattern, detects positions on the base on which the input field is printed. In this way, the information entered in the first input field 6 is recorded by the drawing device, as a sequence of positions.

In the same way a user can enter an illustration in the second input field 7.

Preferably before, but possibly also after, doing this, the user marks the initiation icon 8. When the user has marked the initiation icon 8 he enters information in one of the first 6 or the second 7 input fields. The marking can result in the initiation icon 8 being struck through, crossed out or merely touched by the drawing device. The initiation icon 8 may contain a position-code that exclusively indicates the initiation of a new filing appliance.

As this happens, the drawing device records a coordinate or position in the initiation icon, whereby an operation is initiated in the drawing device for communication with the computer system. In this operation, an information object, which can be, for example, a table in a database or a file, is generated in the computer system. This information object is then identifiable by means of the information entered in one of the input fields 6, 7.

Preferably, at least a subset of the sheets of paper which are attached in the filing appliance is also provided with position-coding patterns, so that notes being made on the sheets of paper using the drawing device are recorded by the same and can be entered in a suitable fashion in the information object created. In the case where the information object is a table, one of the sheets of paper can correspond to an item in the table. The notes can then easily be printed using a printer connected to the computer system. They can also easily be sent to other interested people, for example as e-mail.

According to the present application, a position-coding pattern is generally used, which will later on be described in more detail. The position-coding pattern affords, as mentioned above, the possibility of recording text, digits and illustrations which are written on a sheet of paper, using a drawing device, which is capable of detecting positions on the sheet of paper by means of the position-coding pattern. This text or these digits can be recorded in vector format, but it is also possible to carry out character recognition operations as regards the entered information. An "A" entered on a sheet of paper using a drawing device as described above can thus be recorded either as a set of recorded coordinates, or as the character "A", with a certain ACSII code, for instance subsequent to OCR (Optical Character Recognition) interpretation.

As indicated above, the position-coding pattern can also be used to record Boolean variables, If positions in an initiation icon are recorded by the system, this means that a state in a computer system communicating with the drawing device changes state. When a user ticks a box provided with a position-coding number, this is thus recorded by the system so that a certain parameter is set to be a logic "one".

The first 6 and the second 7 input field as well as the initiation icon 8, can, of course, be located in other parts of the filing appliance, for instance on the bottom cover 9 or one of the attached sheets of paper 10.

Figure 3:
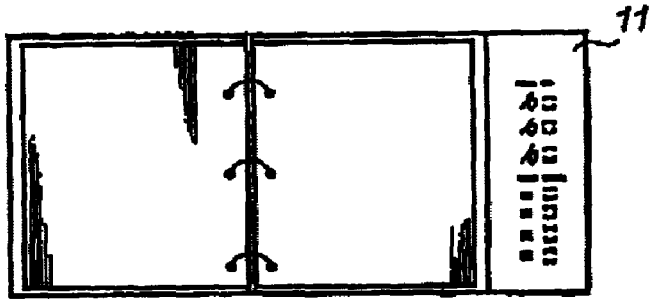
FIG. 3 illustrates an open filing appliance according to an embodiment of the invention with an unfolded palette flap as well as a drawing device and a computer system in connection with which the inventive filing appliance is intended to be used.
Figure 3:
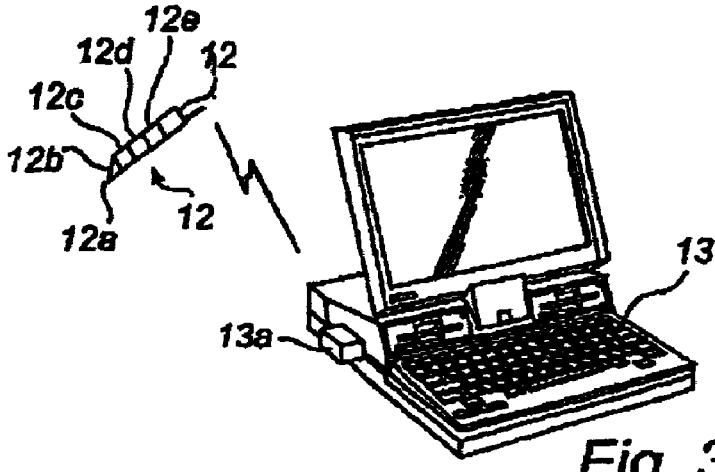

FIG. 3 shows an open filing appliance according to an embodiment of the invention with an unfolded palette flap 11 as well as a drawing device 12 and a computer system 13 (in the case shown, a PC), in connection with which the filing appliance according to the invention is intended to be used. The filing appliance, the drawing device and the computer system jointly form a system for information management. The computer system may also consist of a storage on the Internet.

The palette flap 11 is provided with appearance icons, which are shown more clearly in FIG. 3 and described in more detail in connection with the description of this Figure. Such appearance icons can also be printed on other parts of the filing appliance or on separate slips of paper or rulers.

The drawing device 12 is handheld and preferably of a type which makes an ink trace when writing on a base while at the same time positions on the base are recorded if this is provided with a position-coding pattern, which the drawing device 12 can interpret. The drawing device 12 can communicate with a computer system 13 by means of a cable, a short-range radio link or an IR (infrared) link. The computer system, or the computer unit 13, can also be integrated in the drawing device.

Figure 4:
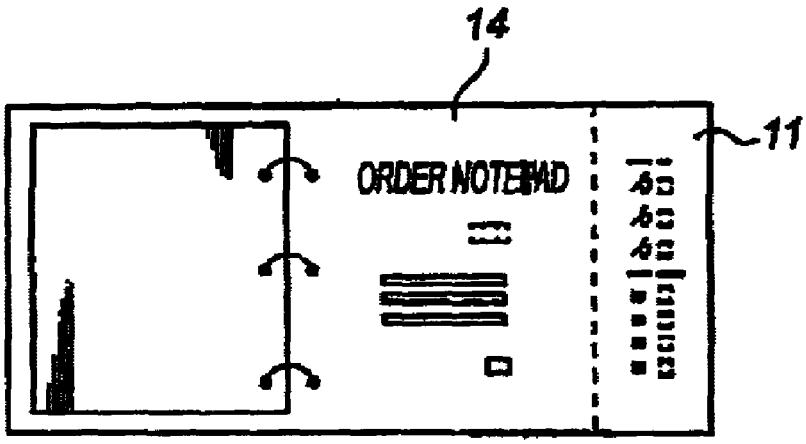
FIG. 4 shows a filing a appliance according to an embodiment of the invention wit an open order page.

FIG. 4 shows a filing appliance according to an embodiment of the invention with an open order page. The order page can be used to order a further filing appliance, for instance when the user's filing appliance is filled with writing. The distinctive features of the order page will be described in more detail in connection with FIG. 9.

Figure 5:
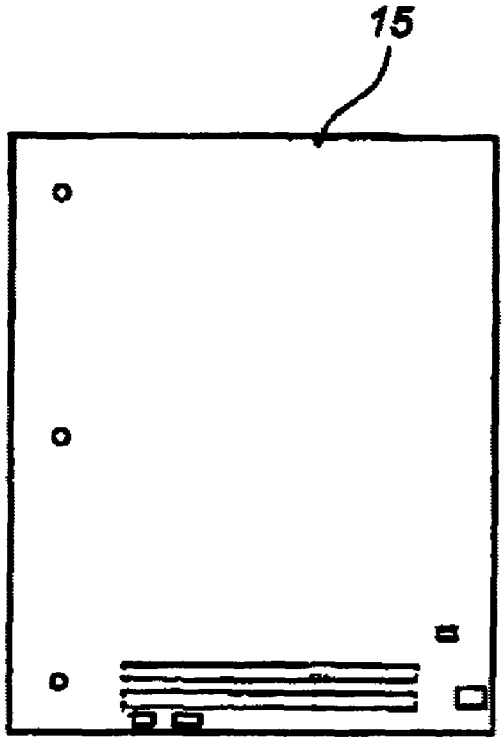
FIG. 5 shows a sheet of paper for a filing appliance according to an embodiment of the invention.

FIG. 5 shows a sheet of paper for a filing appliance according to an embodiment of the invention.

At least one side of the sheet of paper is provided with a position-coding pattern so that notes, which are written on the sheet by means of a drawing device of the above type, can be recorded digitally by the drawing device and then be transmitted to the computer system. The sheet of paper also comprises functionality which is used to initiate transmission of information entered on the page from the drawing device to the computer system and optionally on to an external computer system, which will be described in more detail in connection with FIG. 7.

Figure 6:
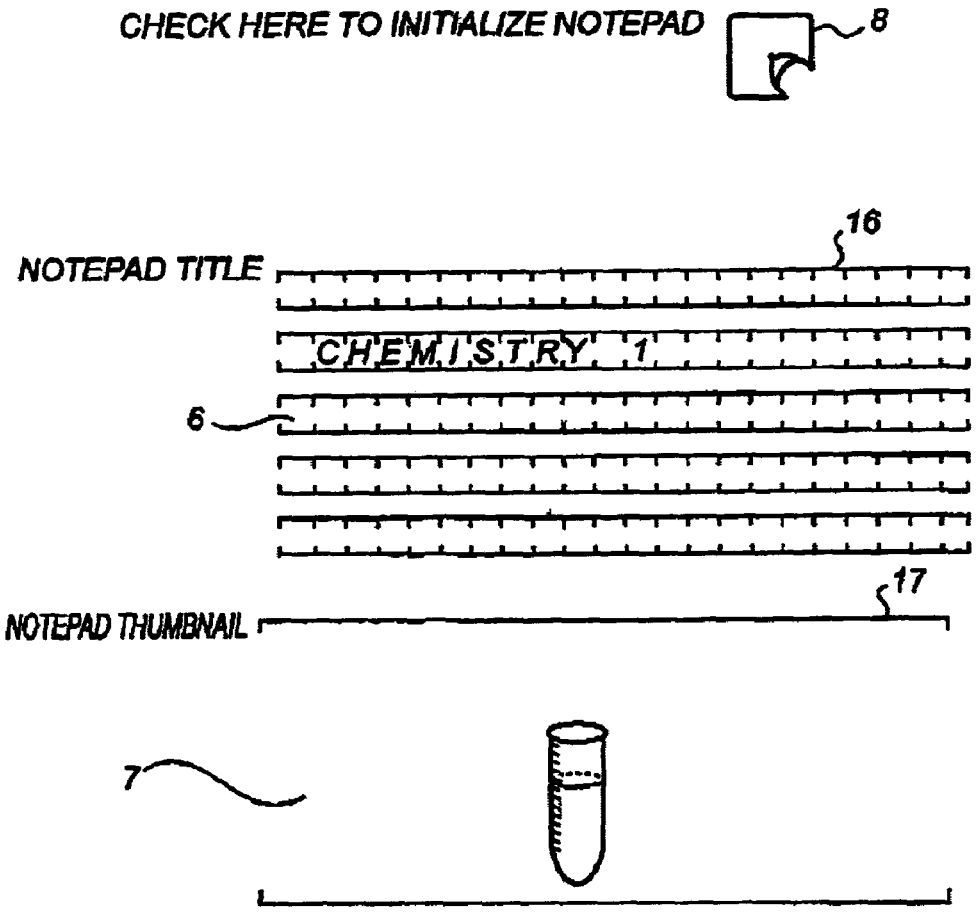
FIG. 6 shows, in a more distinct form, distinctive features of a filing appliance according to the present invention, which are indicated in FIG. 2.

FIG. 6 shows, in a more distinct form, distinctive features of a filing appliance according to the present invention, which are indicated in FIG. 2.

The first input field 6 is adapted to be filled in with text and/or digits, for example as shown "CHEMISTRY 1". The adaptation is made by comb patterns 11 being printed on the base to show the user where information is to be filled in and how large filled-in characters should be, As an alternative to the comb pattern, e.g. a checkered pattern can be used.

The second input sheet 7 is adapted to be filled in with an illustration by a larger area being indicated with a frame 17. In the shown Example, an illustration representing a test tube has been entered in the frame 17.

When the initiation icon 8 has been marked the text and/or the illustration is been entered, whereupon the computer system communicating with the drawing device generates an information object called "CHEMISTRY 1" and is optionally in the computer system linked to an icon representing a test tube.

Figure 7:
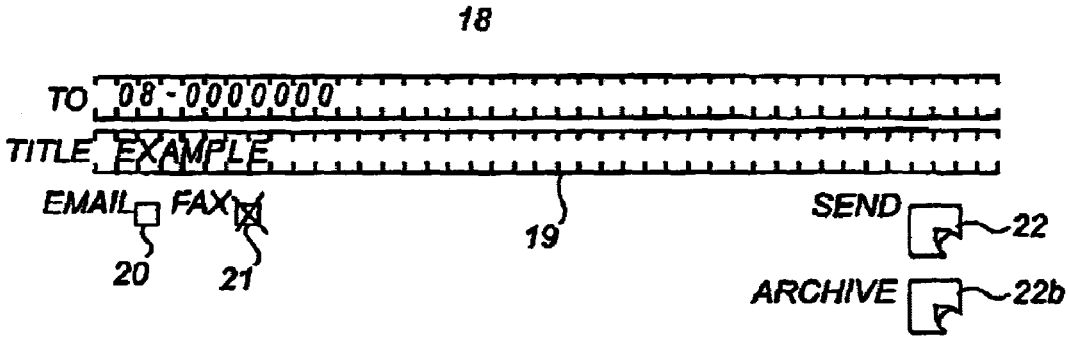
FIG. 7 shows, in a more distinct form, distinctive features indicated on a sheet of paper as shown in FIG. 5.

FIG. 7 illustrates, in a more distinct form, distinctive features indicated on a sheet of paper shown in FIG. 5. A to-field 18, a title field 19, an e-mail box 20, a fax box 21 and a send box 22 are shown on the sheet of paper. Preferably, the entire side of the sheet can be provided with a position-coding pattern. A user may then with a drawing device of the above type write down notes on the sheet of paper, the notes being recorded digitally by the device and being transmittable to the computer system. The digitally recorded information may preferably be inserted in the relevant information object in the computer system. Subsequently the user writes a receiver in the to-field 18. In the shown example, this is a fax number but it may also be an e-mail address. The user may also indicate a title in the title field 19. The title entered can be OCR interpreted and later be included as "subject" in an e-mail message or as title/keyword of a file. The title will then also be searchable. Then one of the e-mail box 20 and the fax box 21 is ticked. In this case, the fax box 21 is selected. When the user then marks the send box 22, an operation in the computer system is initiated by means of the drawing device, in which operation a fax, having contents corresponding to the notes written on the page, is sent by the computer system to the fax number indicated in the to-field.

In more detail, the drawing device 12 (FIG. 3) is provided with a pen point 12*a*, an optical sensor 12*b*, a processor 12*c*, a memory 12*d*, a battery 12*e* and a communication unit 12*f*. The drawing device 12 is adapted to detect the coordinates for its position. The coordinates are stored continuously in a buffer in the memory 12*d*.

A send box 22 can according to the invention consist of a field or a box which on the one hand contains the same continuous coordinate area as the remaining part of the page and, on the other hand, contains coordinates from a specific send region. A dash in the send box then records coordinates from the send region and from the coordinate area of the page.

Pages in the binder, or the binder itself, may also be provided with an archiving icon 22*b*, the use of which will be described below.

When coordinates in the send area are detected, the processor 12*c* reacts and initiates connection to the computer system 13, for example via the communication unit 12*f* and a Bluetooth™ modem 13*a*, which is connected to the computer system 13. An application in the computer system 13 is opened, which application is opened is determined by the coordinates in the send region.

The application records the coordinate area of the page, which is included in the above dash, and initiates a communication where the coordinates which are allocated to the coordinate area of the entire page are demanded, The coordinates that are stored in the buffer memory 12*d* of the drawing device and which belong to the coordinate area of the page are transferred to the application in the computer system, It should be noted that the application can determine that only one page from the binder is to be transferred, or a plurality of pages.

The application then determines how the transferred information is to be processed. Conveniently the information is stored in a file which is marked with the above-mentioned keyword or symbol or an identification in the title line 19, and optionally the date of the transfer.

The application can also be adapted to determine whether the boxes 20 or 25 are marked. If this is the case, the application interprets the contents of the to-field 18 and creates a fax or an e-mail message. Next time the computer system is connected to the telephone network via a fax modem or to the Internet or immediately, the fax or the e-mail message will be sent. The application can also provide an indication that the transmission is accomplished. In e-mail, a copy is suitably sent to the sender's e-mail letter box, confirming that the e-mail message has ban sent.

After transfer of the information, the corresponding buffer memory in the drawing device is erased.

Alternatively, the drawing device may comprise a larger memory and keep all information in the filing appliance in question in the memory. When the next filing appliance is initiated, the memory is emptied to the computer system 13 and stored there permanently, whereupon the use of a new filing appliance is begun. The emptying of the memory can also take place to a server on the Internet etc.

The drawing device can also be arranged to continuously dump the contents of the memory to the computer system, as soon as a communication is established, i.e. as soon as there is contact between the drawing device and the computer system. The contents of the file or the block will then be available from the computer system for inquiries via an Internet connection.

The send box 22 can alternatively be a specific part of the continuous pattern of the page and a send function is then initiated, by the coordinates of the send box fulfilling a certain mathematical relationship, which triggers the processor 12*c* of the drawing device 12.

FIG. 8 shows, in a more distinct form, distinctive features indicated in the palette flap shown in FIG. 3. On the flap there is a set of wholly or partly framed areas 23–29, each having an associated symbol 23'–29'. Such an area 23 together with its associated symbol 23' can be said to be an appearance icon. By marking with the drawing device of the above type such an appearance icon, a subsequent, or preceding, digitally recorded graphical input on a sheet of paper in the filing appliance is given a certain visual property. This can be described as qualification of the graphical input. If, for example, the area 25 associated with the symbol 25' which represents the greatest stroke weight is marked, a subsequent graphical input on a sheet of paper can be given a corresponding stroke weight. This stroke weight does not appear on the sheet of paper but only in the digital recording of what is being written on the sheet. If the digitally recorded information is shown, for instance, in a user interface with the display of the computer system, the graphical input with the selected stroke weight thus appears. In some computer systems, the given visual property need not be shown. FIG. 8 shows three appearance icons 23, 23', 24, 24', 25, 25' for stroke weight and four appearance icons 26, 26', 27, 27', 28, 28', 29, 29' for selecting line color. Other types of qualifications which can be used according to the invention are bold type, italics, underlining, subscript, superscript etc. Qualification can also be made with different degrees of authorization level: all, colleagues, personal etc. Another qualification can be marking as a change.

FIG. 9 shows, in a more distinct form, distinctive features indicated on the order page shown in FIG. 4. Here is an address field 30, in which an address is to be entered. There is also a number field 31, in which the user should write how many additional filing appliances are to be ordered. Moreover there is an order icon 32. Marking of the order icon 3 by means of the drawing device initiates an operation in the computer system. With the operation, which can be carried out, for example, by sending an e-mail message from the computer system, the indicated number of filing appliances is ordered to the indicated address. A filing appliance may further comprise an archiving icon (22*b* , FIG. 7), a marking of the archiving icon being adapted to initiate an operation wherein position information corresponding to strokes of the drawing device, which strokes are generated after a reference time point, is transmitted from the drawing device to the computer system.

A position code that is detected by means of the drawing device is preferably given a time stamp. Hence, each stroke by the drawing device is given a starting time point and an ending time point. A filing appliance preferably comprises an archiving icon, which is provided with a position-coding pattern. The pattern includes such positions that a marking of the archiving icon by means of the drawing device initiates an operation, wherein position information corresponding to strokes of the drawing device, which strokes flare generated after a reference time point $t_{ref}$, is transmitted from the drawing device to the computer system. The reference time point is the time when a computer system was last updated with strokes from the drawing device.

In connection with the transmission of the position information the reference time point is set to the current time.

In an easily implemented embodiment the reference time point is stored in the drawing device. In an alternative embodiment the reference time point may be stored in the computer system. This allows the drawing device to operate vis-à-vis more than one computer system, each having an individual reference time point. When the archiving operation is initiated the computer system requests strokes generated after $t_{ref}$ whereupon $t_{ref}$ is set to the current time.

Figure 12:
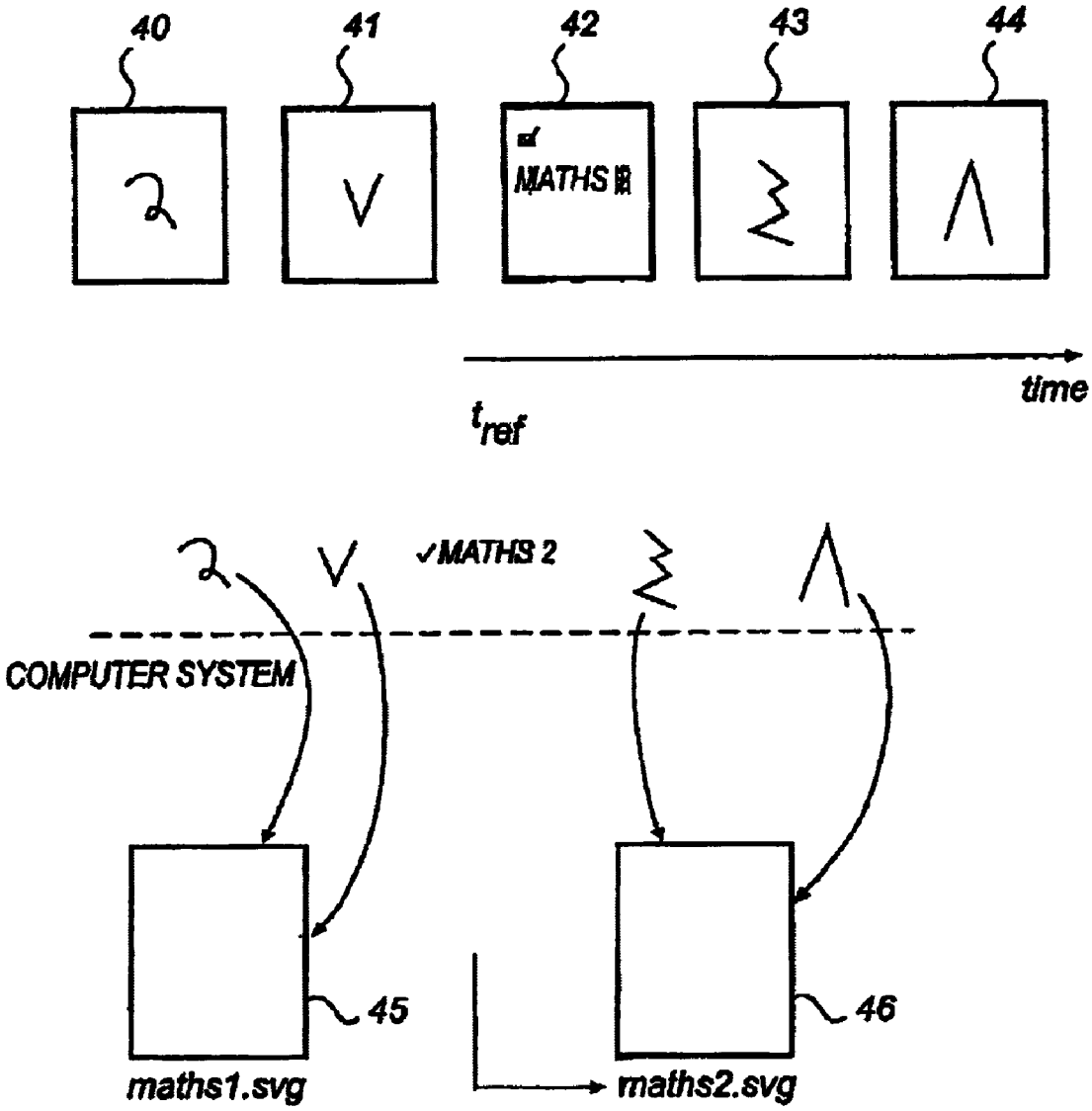
FIG. 12 illustrates a method in a computer system according to an aspect of the invention.

The invention furthermore includes a method for arranging incoming information in a computer system. This method, which is illustrated in FIG. 12, allows a user who is working, offline (i.e. without having the drawing device connected to the computer system) with a first filing appliance (with pages 40, 41) to activate a second filing appliance (with pages 42, 43, 44). Then a first information object 45, named maths 1. svg (svg=scalabel vector graphics), in the computer system is open via-à-vis the application in the computer system that receives position information from the drawing device. The term open indicates that this is the information object to which any received, filing appliance related, information should be inserted, not necessarily that information is currently inserted into the information object, since the user might work offline. The first information object 45 is related to the first filing appliance. When the user, at a time point $t_{acr}$ activates the new, second filing appliance the drawing device continues to record position information. When as described above an archiving icon is marked, the drawing device transmits position information generated both before and after $t_{act}$. This information is received by the computer system. The information that is generated at $t_{act}$ implies that the computer system should make open a second information object 46, named maths 2. svg, vis-à-vis the application in the computer system. The second information object 46 is related to the second filing appliance. According to the inventive method, position information generated before $t_{act}$ (in pages 40, 41) is inserted into the first information object 45, for instance a first file, whereas position information generated after tact (in pages 42, 43, 44) is inserted in the second information object 46, for instance a second file.

Figure 10:
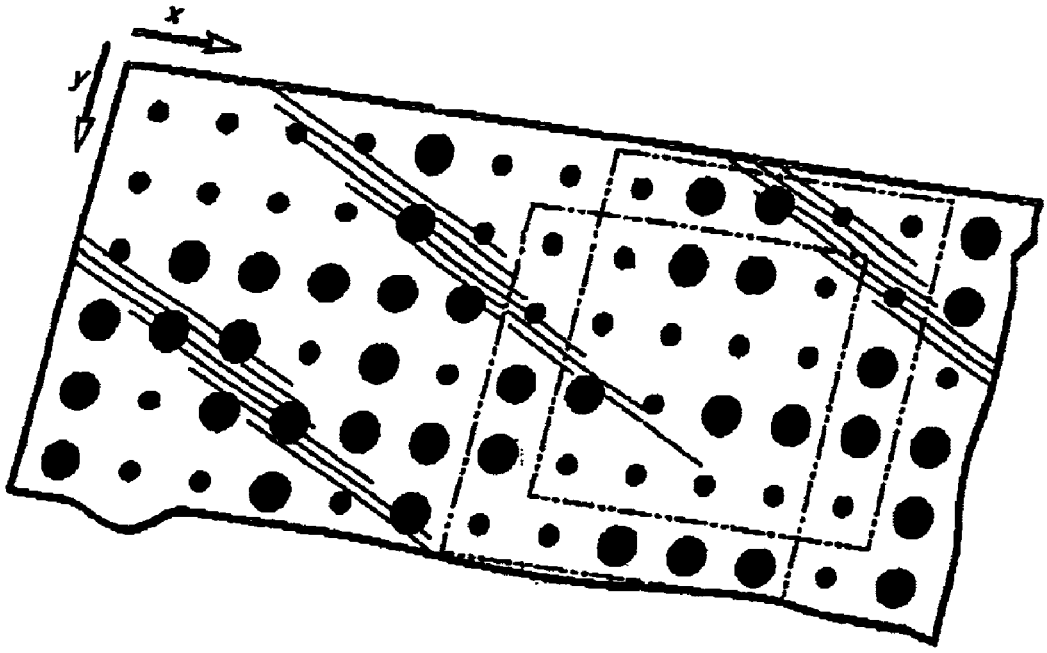
FIG. 10 shows an example of the appearance of a position-coding pattern.
Figure 11:
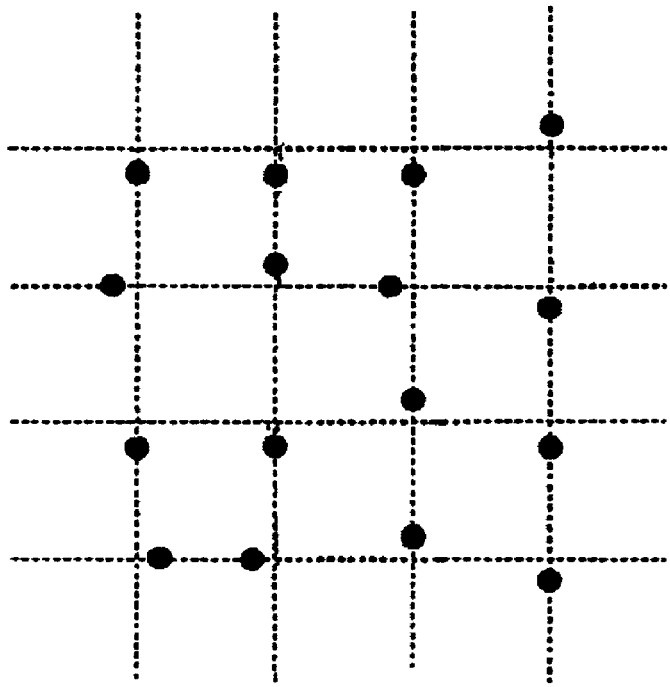
FIG. 11 shows another example of the appearance of a position-coding pattern.

FIG. 10 shows an example of the appearance of a position-coding pattern. The position-coding pattern is absolutely coded, i.e. designed so that if a subset, with a certain minimum size, of the pattern is recorded the position of this subset in the total pattern can be determined unambiguously.

The position-coding patterns shown in Applicant's previous patent applications WO 00/73983 and WO 01/26032 are capable of defining a very large area (for example counted in the number of A4 pages) with high resolution. There each position is coded with a plurality of symbols and each symbol codes a plurality of positions. The position-coding pattern shown in FIG. 10 is made up as shown in WO 00/73983 where a large dot represents a "one" and a small dot represents a "zero". However, it is also possible to design the position-coding pattern as shown in WO 01/26032, see FIG. 1, where different displacements of a dot in relation to a virtual raster pattern (indicated by dashed lines) codes different symbol values.

The invention is not restricted to the embodiments shown above and can be varied within the scope of the appended claims.

The invention claimed is:

1. A filing appliance which facilitates an interaction with a computer system, comprising:

a plurality of tangible sheets associated with a position coding pattern;

at least one first input field accepting markings from a drawing device which digitally records information entered in the first input field;

a second input field accepting descriptive information characterizing the digitally recorded information, wherein the descriptive information associates the filing appliance with an information object; and an initiation icon which, upon activation by the drawing device, signals the computer system to create an information object which is identified based upon the descriptive information entered in the second input field.

2. A method for processing information comprising:

receiving buffered position information from a drawing device, the position information being generated when the drawing device is moved over a position-coding pattern on a plurality of tangible sheets associated with first and second filing appliances, the position information including information that is generated before and after time point $t_{act}$, and further wherein the position information comprises activation information generated at the time point $t_{act}$, the activation information being indicative of an activation of the second filing appliance;

inserting position information generated before said time point $t_{act}$ in a first information object wherein the first information object is related to the first filing appliance, further wherein the first information object resides within a computer system and is associated a first application;

inserting position information generated after said time point $t_{act}$ in a second information object, wherein the second information object is related to the second filing appliance, further wherein the second information object resides within the computer system and is associated with at least one of the first application and a second application.

3. The computer program comprising instructions for performing the method as claimed in claim 2.

4. The memory medium comprising a computer program as claimed in claim 3.

5. A system for information management, comprising:

a drawing device adapted to record a position coding pattern;

a computer system communicatively coupled with the drawing device; and a filing appliance with further comprises, a plurality of tangible sheets associated with the position coding pattern, at least one first input field accepting markings from the drawing device which digitally records information entered in the first input field, a second input field accepting descriptive information characterizing the digitally recorded information, wherein the descriptive information associates filing appliance with an information object, and an initiation icon which, upon activation by the drawing device signals the computer system to create an information object which is identified based upon the descriptive information entered in the second input field;

the system including structure associated at least in part with the drawing device for initiating sending of the digitally recorded information from said drawing device to the computer system.

6. The system according to claim 5, wherein the computer system is integrated with the drawing device.

7. The system according to claim 5, wherein the filing appliance comprises an archiving icon, wherein a detection of the archiving icon by the drawing device initiates an operation wherein position information corresponding to strokes of the drawing device, which strokes are generated after a reference time point, is transmitted from the drawing device to the computer system.

8. The system according to claim 7, wherein the reference time point is updated during the transmission of the position information to a time contemporaneous with the transmission.

9. The system according to claim 7 or 8, wherein the reference time point is stored in the drawing device.

10. The system according to claim 7 or 8, wherein the reference time point is stored in the computer system.

11. A filing appliance which facilitates an interaction with a computer system, comprising:

a plurality of tangible sheets associated with a position coding pattern;

at least one first input field accepting markings from a drawing device which digitally records information entered in the first input field;

a second input field accepting descriptive information characterizing the digitally recorded information, wherein the descriptive information associates the filing appliance with an information object; and an initiation icon which, upon activation by the drawing device, signals the computer system to create an information object which is identified based upon the descriptive information entered in the second input field;

a number of appearance icons, a detection of an appearance icon by means of said drawing device being adapted to give the digitally recorded information a visual property.

12. The filing appliance according to claim 1, wherein said first and second input fields are adapted to be filled in at least with text.

13. The filing appliance according to claim 1 or 2, wherein said second input field is adapted to be filled in at least with an illustration.

14. The filing appliance according to claim 1, wherein sheets in at least a subset of said plurality of sheets are provided with a position-coding pattern so that information filled in on a sheet in the subset by said drawing device is recordable as a digital graphical input.

15. The filing appliance according to claim 1, wherein said visual property relates at least to stroke weight.

16. The filing appliance according to claim 1 or 15, wherein said visual property relates at least to line color.

17. The filing appliance according to claim 1, which comprises an address field provided with a position-coding pattern, and an order icon, a detection of the order icon by said drawing device being adapted to initiate an operation in the computer system which operation performs an order of another filing appliance to be delivered to the address entered in the address field.

18. The filing appliance of claim 1, wherein the initiation icon is provided with a position-coding pattern.

19. The filing appliance according to claim 1, wherein the information object is re-accessible by reactivating of the initiation icon.

20. A filing appliance which facilitates an interaction with a computer system, comprising:

a plurality of tangible sheets associated with a position coding pattern;

at least one first input field accepting markings from a drawing device which digitally records information entered in the first input field;

a second input field accepting descriptive information characterizing the digitally recorded information, wherein the descriptive information associates the filing appliance with an information object; and an initiation icon which, upon activation by the drawing device, signals the computer system to create an information object which is identified based upon the descriptive information entered in the second input field; and a send icon provided with a position-coding pattern, a detection of the send icon by means of the drawing device initiating an operation in the computer system, in which operation the digitally recorded information is transferred to the computer system.

21. The filing appliance according to claim 20, wherein said information object comprises table in a database.

22. The filing appliance according to claim 20, wherein said information object comprises a file.

23. The filing appliance to claim 20, further comprising an archiving icon, detection of the archiving icon by the drawing device being adapted to initiate an operation wherein position information corresponding to strokes of the drawing device, which strokes are generated after a reference time point, is transmitted from the drawing device to the computer system.

24. The filing appliance according to claim 20, wherein at least two sheets in a subset of said plurality of sheets are provided with a position-coding pattern, so that information filled in on a sheet in the subset can be recorded by said drawing device as digital graphical inputs.

25. A filing device comprising:

a holder for holding a plurality of tangible sheets;

at least one first input field accepting markings from a drawing device which digitally records information entered in the first input field;

a second input field accepting descriptive information characterizing the digitally recorded information, wherein the descriptive information associates the filing appliance with an information object; and an initiation icon which upon activation by the drawing device, signals the computer system to create an information object identified based upon the descriptive information entered in the second input field; and a send icon provided with a position-coding pattern, a detection of the send icon by means of the drawing device initiating an operation in the computer system, in which operation the digitally recorded information is transferred to the computer system.

26. The filing device of claim 25, wherein the information object electronically represents the filing device.

27. A filing device according to claim 25, wherein the filing device comprises an archiving icon, wherein a detection of the archiving icon by the drawing device initiates an operation wherein position information corresponding to strokes of the drawing device, which strokes are generated after a reference time point, is transmitted from the drawing device to the computer system.

* * * * *

UNITED STATES PATENT AND TRADEMARK OFFICE

CERTIFICATE OF CORRECTION

PATENT NO. : 7,127,682 B2
APPLICATION NO. : 09/986378
DATED : October 24, 2006
INVENTOR(S) : Ola Sandström et al.

It is certified that error appears in the above-identified patent and that said Letters Patent is hereby corrected as shown below:

In the Claims:

In Claim 1 is the wrong claim altogether. Please replace claim 1 with the following:

Col. 10, Line 5 should read

--1. A drawing device comprising:

a sensor for sensing position information from a position-coding pattern on a plurality of tangible sheets associated with first and second filing appliances; and a memory for storing the sensed positional information, the position information including information that is generated before and after time point $t_{act}$, wherein position information sensed before said time point $t_{act}$ is to be inserted in a first information object wherein the first information object is related to the first filing appliance, further wherein the first information object resides within a computer and is associated with a first application, and wherein position information generated after said time point $t_{act}$ is to be inserted in the second information object, wherein the second information object is related to a second filing appliance, further wherein the second information object resides within the computer system and is associated with at least one of the first application and a second application, and further wherein the position information comprises activation information generated at the time point $t_{act}$, the activation information being indicative of an activation of the second filing appliance.--

Claim 12, line 1, change “1” to --11--.

Claim 13, line 1, change “1 or 2” to --11 or 12--.

Claim 14, line 1, change “1” to --1--.

Claim 15, line 1, change “1” to --1--.

Claim 16, line 1, change “1” to --1--.

Claim 17, line 1, change “1” to --1--.

Claim 18, line 1, change “1” to --1--.

UNITED STATES PATENT AND TRADEMARK OFFICE

CERTIFICATE OF CORRECTION

PATENT NO. : 7,127,682 B2
APPLICATION NO. : 09/986378
DATED : October 24, 2006
INVENTOR(S) : Ola Sandström et al.

It is certified that error appears in the above-identified patent and that said Letters Patent is hereby corrected as shown below:

Claim 19, line 1, change "1" to --1--.

Signed and Sealed this

Sixteenth Day of October, 2007

JON W. DUDAS
*Director of the United States Patent and Trademark Office*